US005878581A

United States Patent [19]

DeFrances et al.

[11] Patent Number: 5,878,581

[45] Date of Patent: Mar. 9, 1999

[54] CLOSED MULTI-LOOP WATER-TO-WATER HEAT EXCHANGER SYSTEM AND METHOD

[75] Inventors: Larry DeFrances, Greensburg; Larry J. Gaudino, Belle Vernon, both of Pa.

[73] Assignee: Advanced Metallurgy Incorporated, Export, Pa.

[21] Appl. No.: 957,886

[22] Filed: Oct. 27, 1997

[51] Int. Cl.[6] ..... F17C 9/02

[52] U.S. Cl. ..... 62/50.2; 62/434

[58] Field of Search ..... 62/50.2, 434

[56] References Cited

U.S. PATENT DOCUMENTS 3,672,182 6/1972 Stowasser et al. ..... 62/70
4,464,904 8/1984 Steigman ..... 62/434

*Primary Examiner*—Ronald Capossela
*Attorney, Agent, or Firm*—Armstrong, Westerman, Hattori, McLeland & Naughton

[57] ABSTRACT

An apparatus and method of heat exchange in which a liquified gas is evaporated in a first coil disposed in a fluid heat exchange medium in a heat exchanger, absorbing heat by the evaporating liquid to chill the heat exchange medium, disposing in the heat exchange medium in the heat exchanger a second coil containing heat exchange medium in fluid connection with a body of heat exchange medium contained in a reservoir, chilling the heat exchange medium in the heat exchanger and circulating chilled heat exchange medium to the reservoir and from the reservoir to a facility location needing cooling, returning warmed heat exchange medium from the facility location to the reservoir and thence to the second coil for rechilling and reuse.

14 Claims, 1 Drawing Sheet

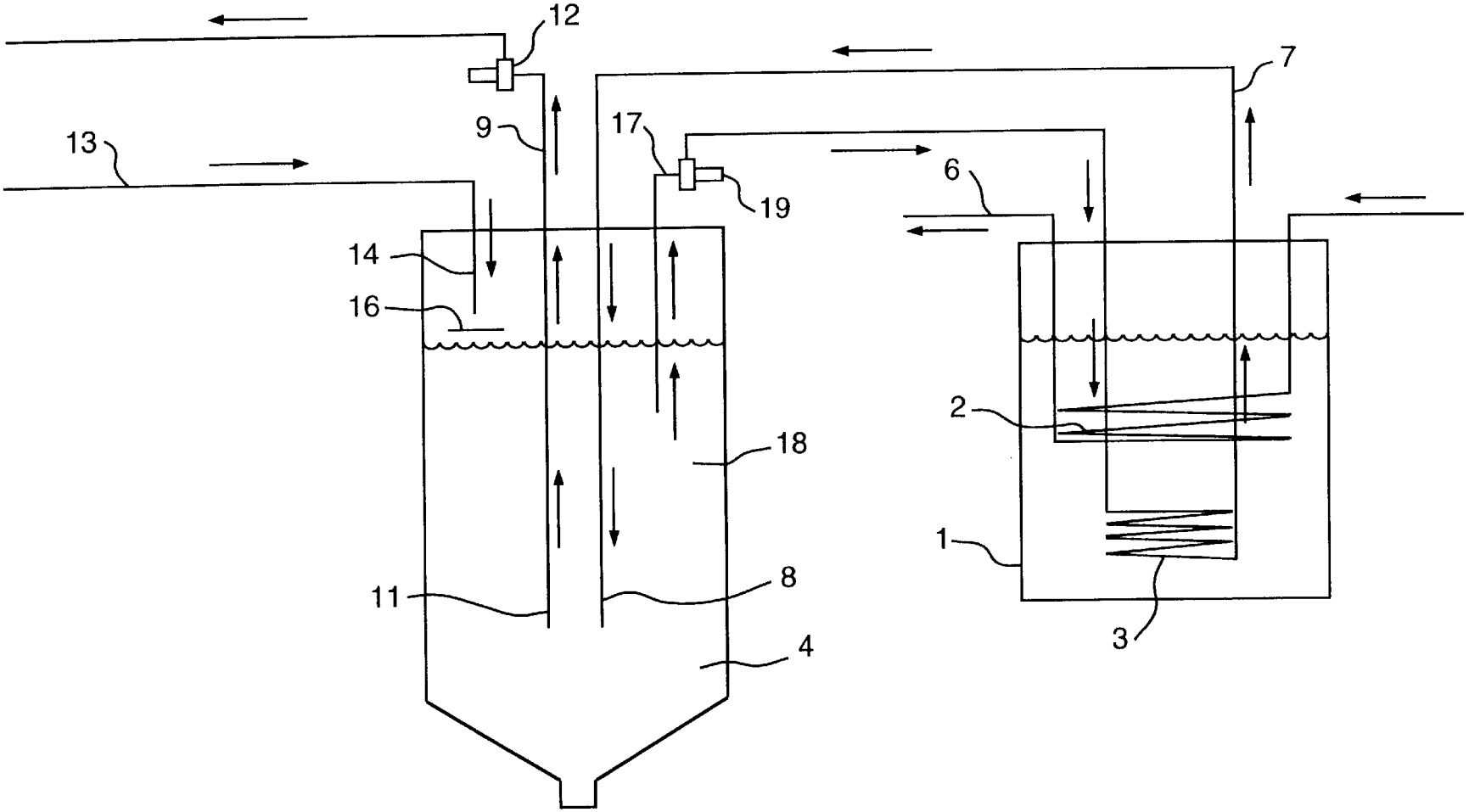
7
6
2
1
3
19
17
18
8
4
12
9
14
16
11
13

CLOSED MULTI-LOOP WATER-TO-WATER HEAT EXCHANGER SYSTEM AND METHOD

BACKGROUND

1. Field of the Invention

This invention relates to new and improved heat exchanger systems and methods in which the endothermic potential of the evaporation of liquified gas such as nitrogen is used to cool process cooling water.

2. Prior Art

In industrial plants and processes, cooling fluid such as water often is needed. Cooling of such fluids most often is accomplished by the use of radiator-type cooling systems. Unless such systems are designed to accommodate the most severe requirement, e.g. during the hottest days of summer, varying quantities of city water may have to be used to supplement the cooling capacity of the closed cooling system. Such excess amounts of cooling water must be discharged from the system, e.g. to the sewer. However, many governmental regulations prohibit such disposal of cooling fluid, necessitating that the fluid be discharged into on-site treatment facilities. The accompanying expense is unattractive. Over-designing the radiator-type cooling system for assuring necessary cooling capability for, perhaps, only a few days per year is costly in terms of both capital investment and operating expenses.

Closed loop heat exchangers are known in which a first cold fluid in a closed loop functions to lower the temperature of a second cooling fluid.

SUMMARY OF THE INVENTION

Many industrial facilities requiring the use of cooling fluids also entail the use of nitrogen or other liquefiable gases wherein the conversion of such gases from liquid form, in which the gas is stored, to gaseous form is endothermic. The present invention takes advantage of the endothermic nature of evaporation of liquified gas, such as nitrogen, as a primary coolant, by gasifying the fluid in a first loop coil immersed in a secondary coolant fluid-filled heat exchanger vessel to reduce the temperature of the secondary coolant in a second loop in the heat exchanger, and passing the cooled secondary coolant to a reservoir from which cooled secondary coolant is passed in a third loop to relevant equipment and processes and from which reservoir heated secondary coolant is returned, through the second loop, to the heat exchanger.

BRIEF DESCRIPTION OF THE DRAWING

The single drawing is a schematic illustration of the invention in side elevation showing the several loops and associated tanks and the directions and illustrative temperatures of the several streams of warm and cold secondary cooling fluid and the primary liquid and gaseous cooling fluid.

DESCRIPTION OF PREFERRED EMBODIMENTS

In the FIGURE, the numeral 1 denotes a heat exchanger, which may take the form of a generally cylindrical vessel, containing a heat exchange medium, such as water, and in which is immersed a coil 2 as part of a first loop for introduction into heat exchanger 1 of liquid primary coolant, such as nitrogen, from a bulk cryogenic storage tank (not shown) for expansion from liquid to gaseous form in the coil 2 and, due to the endothermic nature of evaporation and expansion in coil 2 of the liquid to gaseous primary coolant, reducing the temperature of a secondary coolant, such as water, in a coil 3 of a second loop which connects with a liquid reservoir 4 and which carries cooled secondary coolant via the second loop from the heat exchanger 1 to the reservoir 4.

The first loop leaves the heat exchanger 1 through a line 6 and carries the gasified primary coolant to process equipment as needed.

The second loop exits the heat exchanger 1 through a line 7, with the secondary coolant at a relative cool temperature, e.g. about 58°–65° F., and line 7 enters the reservoir 4 from the top of the vessel and one end extends to near the bottom of the reservoir as shown at 8 in the drawing.

The third loop comprises a line 9 extending inside the reservoir to an end 11 at a depth approximately that of end 8 of line 7 of the second loop, leaves the top of the reservoir 4, passing through a pump 12, and, with the secondary coolant at a needed cooling temperature, e.g. about 62°–70° F., passes to the relevant equipment and processes. The third loop is completed with the return of warmed secondary coolant from the relevant equipment and processes at an elevated temperature, e.g. about 85°–100° F., through a line 13 which enters the top of reservoir 4 and extends to an end 14 located just above the fluid level in reservoir 4. Optimally, a flat baffle plate 16 is positioned below the end 14 of line 13 to better distribute, over at least a substantial portion of the surface of the liquid in the reservoir 4, the warmed secondary coolant in its return to the reservoir. By virtue of such construction and operation of the system of the invention, there is established a temperature gradient in the reservoir 4, from warmer condition of the secondary coolant near the top of the reservoir, to a cooler condition near the bottom of the reservoir.

The second loop is completed by a line 17 exiting the top of reservoir 4 and having an end 18 disposed in the reservoir just under the surface of the secondary fluid therein, passing through a second pump 19, and continuing on to enter the heat exchanger vessel 1 and form coil 3 disposed below the liquid-to-gas expansion coil 2.

Exemplarily, the primary coolant is nitrogen and the heat exchange medium and the secondary coolant is water. In a specific example, using such equipment and with approximately 270,000 gallons of liquid nitrogen available for process and/or equipment cooling needs, there are over 182 million cooling BTUs available from expansion of the liquid nitrogen into gaseous form. It takes about 250 BTUs of cooling to chill ten pounds of water by 25° F., and, considering external cooling losses, such a nitrogen supply provides enough cooling to chill 8000 gallons of water 25° F. In such case reservoir 4 may have a volume of about 8000 gallons, and heat exchanger 1 may have a volume of about 500 gallons. In such a system, end 18 of line 17 in the second loop is disposed about one foot below the water level in reservoir 4; end 8 of line 7 is disposed about 8 feet below the water level in the reservoir; the end 11 of line 13 is disposed about 9 feet below the water level in the reservoir, and end 14 of line 13 is disposed about one foot above the water level in the reservoir 4.

Accordingly, in a facility needing cooling water and a substantial amount of nitrogen coolant, this invention avoids the wasteful loss to the atmosphere of cooling BTUs inherent in the evaporation of nitrogen by using those BTUs for cooling water and thus further reducing costs by avoiding the need for over-designed or supplemental conventional cooling means.

What is claimed is:

1. A closed multi-loop fluid-to-fluid heat exchange system comprising:

a) a heat exchanger for containing a fluid heat exchange medium;

b) a reservoir for containing a secondary coolant fluid;

c) a first closed loop comprising a source of liquified gas primary coolant providing an endothermic evaporation of the liquified gas, a first line extending from the liquified gas source into the heat exchanger and forming a first coil immersed in the heat exchange medium in the heat exchanger and serving as an evaporator for the liquified gas, and a second line for conveying gaseous primary coolant from the first coil to a needed cooling location in a facility;

d) a second closed loop comprising a second coil disposed in the heat exchanger at a position below that of the first coil, a third line having one end disposed below and near a surface level of secondary coolant in the reservoir and leading to the second coil, and means to pump warmed secondary coolant through the third line, and a fourth line connected at one end to the second coil and having the other end disposed in the reservoir at a location near a bottom of the reservoir to convey chilled secondary coolant from the heat exchanger to the reservoir, and e) a third closed loop comprising a fifth line having one end thereof disposed near the bottom of the reservoir and adapted with pump means to convey chilled secondary coolant to a needed facility location, and a sixth line extending from the needed facility location to a position near the liquid level in the reservoir.

2. A system according to claim 1, wherein the primary coolant is nitrogen, the secondary coolant and the heat exchange medium is water, and warmed secondary coolant is returned from the facility location to a position above the level of secondary coolant in the reservoir.

3. A closed multi-loop heat exchange system comprising a heat exchanger vessel for containing a fluid heat exchange medium, a reservoir for containing a secondary coolant fluid, a first coil immersed in the heat exchange medium in the heat exchanger vessel, a second coil immersed in the heat exchange medium in the heat exchanger vessel, means to introduce liquified gas primary coolant fluid into the first coil and there to expand the primary coolant fluid to gaseous form with the absorption of heat, and to transfer the gasified primary coolant to a needed facility location needing cooling, means to transfer chilled secondary coolant fluid from the heat exchanger vessel to the reservoir, means to transfer the chilled secondary coolant fluid from the reservoir to a facility location needing cooling and to return warmed secondary cooling fluid to the reservoir, and means to transfer warmed secondary cooling fluid from the reservoir to the second coil in the heat exchanger vessel for rechilling and reuse.

4. A system according to claim 3, wherein the second coil is disposed below the first coil, the primary coolant fluid is nitrogen, and the secondary coolant fluid and the heat exchange medium is water, and warmed water is returned from the facility to a location above a water surface level in the reservoir.

5. A system according to claim 4, wherein chilled water is introduced from the heat exchanger vessel into a bottom portion of the reservoir, chilled water is removed from the reservoir from a bottom portion thereof, circulated in the third loop to the facility location and returned to the reservoir near the water surface therein, and warmed water is returned from the reservoir through the second loop to the second coil in the heat exchanger vessel.

6. A system according to claim 5, further comprising a baffle plate disposed below a fluid exit of the third loop located above a water surface in the reservoir to aid in distributing warmed water from the facility equipment and processes above the water surface in the reservoir.

7. A method of heat exchange, comprising providing a heat exchanger containing a fluid heat exchange medium, disposing in the heat exchange medium in the heat exchanger a first coil containing a primary coolant consisting of a liquified gas, disposing below the first coil in the heat exchanger a second coil containing secondary coolant fluid and in fluid communication with a secondary coolant fluid reservoir, evaporating liquid primary coolant to gaseous form in the first coil to chill the heat exchange medium in the heat exchanger and transferring heat by means of the heat exchange medium in the heat exchanger to chill the secondary coolant fluid in the second coil, transferring the chilled secondary coolant from the second coil to the reservoir, circulating chilled secondary coolant from the reservoir to a facility location needing cooling, and circulating warmed secondary coolant back to the reservoir and thence to the second coil where it is again chilled and reused.

8. A method according to claim 7, wherein the primary coolant is nitrogen and the secondary coolant and heat exchange medium is water.

9. A method according to claim 8, wherein chilled water is conveyed from the heat exchanger to a bottom portion of the reservoir, chilled water from the reservoir is drawn from a bottom portion of the reservoir and circulated to a facility location needing cooling and warmed water is returned from the facility location to the reservoir at a position near the water surface in the reservoir, and returning warmed water from near the water surface in the reservoir to the second coil for rechilling and reuse.

10. A method according to claim 9, further comprising returning the warmed water from the facility location to the reservoir at a location above the water surface in the reservoir, and distributing the returned warmed water over at least a substantial portion of the surface of the water in the reservoir.

11. A method of heat exchange comprising evaporating a liquified gas in a first coil disposed in a fluid heat exchange medium in a heat exchanger, conveying the resulting cool gas to a facility location needing cooling, absorbing heat by the evaporating liquid and chilling the heat exchange medium, disposing in the heat exchange medium in the heat exchanger a second coil containing secondary cooling fluid in fluid connection with a body of secondary cooling fluid contained in a reservoir, chilling the heat exchange medium in the heat exchanger and thereby chilling the secondary cooling fluid, circulating chilled secondary cooling fluid to the reservoir and from the reservoir to a facility location needing cooling, returning warmed secondary cooling fluid from the facility location to the reservoir and thence to the second coil for rechilling and reuse.

12. A method according to claim 11, wherein the liquified gas is nitrogen and the fluid heat exchange medium and the secondary cooling fluid is water.

13. A method according to claim 12, comprising conveying chilled water from the heat exchanger to a bottom portion of the reservoir, drawing chilled water from a bottom portion of the reservoir and circulating it to a facility location needing cooling, returning warmed water from the facility location to the reservoir at a position near the water surface in the reservoir, and returning warmed water from near the water surface in the reservoir to the second coil for rechilling and reuse.

14. A method according to claim 13, further comprising returning the warmed water from the facility location to a location spaced above the surface of water in the reservoir, and distributing the warmed water over a least a substantial portion of the surface of water in the reservoir.

* * * * *